United States Patent [19]

Tanabe et al.

[11] Patent Number: 4,632,885

[45] Date of Patent: Dec. 30, 1986

[54] ALUMINUM BASE ALLOY CLAD MATERIAL FOR USE IN HEAT EXCHANGERS

[75] Inventors: Zenichi Tanabe, Nagoya; Toshiyasu Fukui, Toyoake; Teruo Uno, Nagoya; Hiroshi Ikeda, Toyoake, all of Japan

[73] Assignee: Sumitomo Light Metal Industries, Ltd., Tokyo, Japan

[21] Appl. No.: 356,988

[22] Filed: Mar. 11, 1982

Related U.S. Application Data

[63] Continuation of Ser. No. 168,216, Jul. 10, 1980, abandoned.

[30] Foreign Application Priority Data

Jul. 23, 1979 [JP] Japan ..... 54-92610

[51] Int. Cl.[4] ..... B32B 15/01

[52] U.S. Cl. ..... 428/654; 420/542; 420/543

[58] Field of Search ..... 428/650–654; 75/140, 147; 165/DIG. 8

[56] References Cited

U.S. PATENT DOCUMENTS

| | | | |
|---|---|---|---|
| 3,133,796 | 5/1964 | Craig, Jr. | 428/654 |
| 3,496,620 | 2/1970 | Wolfe, Jr. | 428/654 |
| 3,963,453 | 6/1976 | Singleton, Jr. | 428/654 |
| 4,040,822 | 8/1977 | Stern | 75/140 |
| 4,203,490 | 5/1980 | Terai et al. | 165/180 |
| 4,244,756 | 1/1981 | Tanabe et al. | 75/140 |

FOREIGN PATENT DOCUMENTS

| | | | |
|---|---|---|---|
| 45-1539 | 1/1970 | Japan | 75/147 |
| 487151 | 8/1976 | U.S.S.R. | 75/147 |

OTHER PUBLICATIONS

1978 *Databook Metal Progress*, (Mid Jun., 1978) pp. 88–89, TS300M587.

*Primary Examiner*—L. Dewayne Rutledge
*Assistant Examiner*—Robert L. McDowell
*Attorney, Agent, or Firm*—Flynn, Thiel, Boutell & Tanis

[57] ABSTRACT

A clad material for use in heat exchangers comprises a core metal layer made of an aluminum base alloy containing Mg, and a cladding metal layer made of an aluminum base alloy containing Sn and Mg. The core metal layer can contain at least one metal selected from the group consisting of Mn, Si, Cr, Cu and Zr, and a cladding metal layer can also contain at least one metal selected from the group consisting of Zn, Ti, In and Ga.

10 Claims, 2 Drawing Figures

ALUMINUM BASE ALLOY CLAD MATERIAL FOR USE IN HEAT EXCHANGERS

This is a continuation of application Ser. No. 168,216, filed July 10, 1980, abandoned.

BACKGROUND OF THE INVENTION

The present invention relates to an aluminum base alloy clad material for use in heat exchangers in which corrosive liquid is employed as a heat exchange fluid, and more particularly to an aluminum base alloy clad material which is resistant to corrosion in corrosive liquids due to a sacrificial anode effect afforded by a soldering process in a non-oxidizing and reduced-pressure atmosphere when making heat exchangers, and which is also workable in order to make parts for heat exchangers.

Aluminum heat exchangers are now in use widely and the heat exchange tubes of aluminum heat exchangers are made of aluminum or aluminum base alloys. However, the use of aluminum or aluminum base alloys is limited to coolers and refrigerators whose heat exchange liquids are non-corrosive, for example, Freon made by E. I. du Pont de Nemours & Co., Inc.

This is because when the heat exchange fluid is water, for example, in which some corrosive materials are unavoidably dissolved, as in the case of radiators of cars, considerable pitting corrosion occurs in the fluid passage members, such as plates, tubes or frames, made of aluminum or aluminum base alloys, of the heat exchangers, so that there is a risk that fluid leakage accidents may occur. As a countermeasure for preventing such accidents, prevention of corrosion by utilizing sacrificial anodes is known to be effective and it is widely known that Al-Zn base alloys are useful for that purpose.

However, when heat exchangers are assembled, insomuch Al-Zn base alloys, by soldering methods in a non-oxidizing and reduced-pressure atmosphere, such as by a vacuum soldering method or a pressure-adjusted soldering method, zinc is evaporated during the soldering process and may impair the sacrificial anode effect, although such soldering methods have advantages over other methods in terms of productivity and prevention of air pollution. Therefore, it is disadvantageous to use Al-Zn base alloys for assembling heat exchangers when the above-mentioned methods are employed.

The inventors of the present invention have proposed the use of Al-Sn base alloys as materials suitable for sacrificial anodes which do not have the above-mentioned shortcomings. However, Al-Sn base alloys have problems, such low workability during the manufacture of the parts for heat exchangers due to grain boundary diffusion and occasional intergranular corrosion of Sn.

SUMMARY OF THE INVENTION

It is therefore an object of the present invention to provide a clad material for use in heat exchangers comprising a core metal layer made of an aluminum base alloy containing Mg, and a cladding metal layer made of an aluminum base alloy containing Sn and Mg.

Another object of the present invention is to provide a clad material for use in heat exchangers, comprising a core metal layer made of an aluminum base alloy containing Mg and at least one metal selected from the group consisting of Mn, Si, Cr, Cu and Zr, and a cladding metal layer made of an aluminum base alloy containing Sn and Mg and at least one metal selected from the group consisting of Zn, Ti, In and Ga.

The above-mentioned clad materials are resistant to pitting corrosion.

Extensive corrosion tests of the above-mentioned clad materials showed that they are extremely resistant to pitting corrosion. Accordingly, they are useful as the fluid passage members, such as plates, tubes or frames, of heat exchangers. In addition, these clad materials have sufficient workability and malleability during the preparation of the fluid passage members.

Furthermore, said clad materials are useful not only for the construction of members of heat exchangers of coolers and refrigerators using non-corrosive heat exchange fluids, but also for the construction of members of radiators and heat cores of cars, oil coolers and solar heat collectors.

DETAILED DESCRIPTION OF THE PREFERRED EMBODIMENTS

Figure 1:
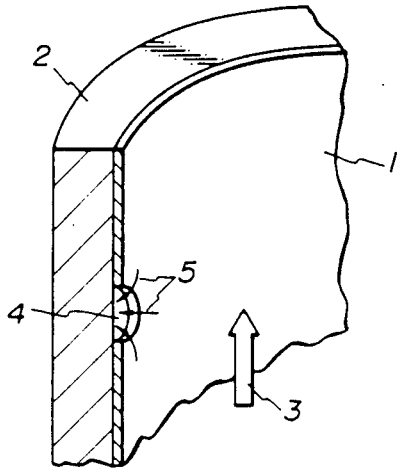
FIG. 1 illustrates the corrosion prevention effect of a clad material according to the present invention employed in a water pipe.

A first embodiment of a clad material according to the present invention for use in heat exchangers comprises a core metal layer made of a aluminum base alloy containing Mg in the range of 0.01 to 2 wt.%, and a cladding metal layer made of an aluminum base alloy containing Sn in the range of 0.02 to 0.5 wt.% and Mg in the range of 0.02 to 2 wt.%.

A second embodiment of a clad material according to the present invention for use in heat exchangers comprises a core metal layer made of an aluminum base alloy containing Mg in the range of 0.01 to 2 wt.% and at least one metal selected from the group consisting of Mn in the range of 0.01 to 2 wt.%, Si in the range of 0.01 to 2 wt.%, Cr in the range of 0.01 to 0.5 wt.%, Cu in the range of 0.01 to 0.5 wt.% and Zr in the range of 0.01 to 0.5 wt.%, and a cladding metal layer made of an aluminum base alloy containing Sn in the range of 0.02 to 0.5 wt.% and Mg in the range of 0.02 to 2 wt.% and at least one metal selected from the group consisting of Zn in the range of 0.05 to 3 wt.%, Ti in the range of 0.01 to 0.5 wt.%, Indium in the range of 0.02 to 1 wt.% and Ga in the range of 0.02 to 1 wt.%.

In both embodiments according to the present invention, Sn contained in each cladding metal layer serves to make the cladding metal layer anodic in heat exchange fluid, so that a sacrificial anode effect is given to the cladding metal layer. As a result, the core metal layer, fillets and other heat exchanger construction members in contact with the heat exchange fluid are prevented from being corroded. When the content of Sn is less than .02 wt.%, the desired corrosion prevention effect is not obtained. On the other hand, when the content of Sn exceeds 0.5 wt.%, adverse effects occur such as shortening of the duration of the corrosion prevention effect due to the increase in the rate of self-corrosion, and excessive corrosion prevention.

Mg is contained in the cladding metal layer and in the core metal layer. In the embodiment in which the cladding metal layer contains Mg, $Mg_2Sn$ is formed in combination with Sn, which makes it hard for Sn to diffuse, so that Sn grain boundary diffusion and tear cracks of the cladding metal layer during a hot-rolling process, which are shortcomings of Sn, are prevented. Furthermore, since the vapor pressure of Mg is high, Mg is evaporated in a furnace. As a result, Mg which is present in the form of $Mg_2Sn$ in the cladding metal layer prior to the soldering process in the non-oxidizing atmosphere is evaporated during the soldering process so that Sn precipitates in the aluminum and gives a sacrificial anode effect to the cladding metal layer.

Mg added to the core metal layer suppresses Sn grain boundary diffusion as well, so that it serves to prevent tear cracks in the core metal during hot rolling and working, and prevents intergranular corrosion.

When the amount of Mg added is less than its minimum amount in the cladding metal layer and the core metal layer, the above-mentioned effects cannot be obtained sufficiently. On the other hand, when the amount of Mg exceeds its upper limit in the cladding metal layer or the core metal layer, Mg present near the surface of each layer does not evaporate sufficiently. As a result, the sacrificial anode effect is reduced.

In the second embodiment, Zn, In and Ga added to the cladding metal layer improve the sacrificial anode effect of Sn, while Ti improves workability of the cladding metal layer. When the contents of these substances are less than their previously mentioned respective lower limits, the above-mentioned effects cannot be obtained. On the other hand, when the contents of these substances exceed their respective upper limits, an increase in the rate of self-corrosion and excessive corrosion prevention are apt to occur.

In the second embodiment, Si and Cu added to the core metal layer make the potential of the core metal layer cathodic and improve the strength of the core metal layer. Cr, Mn and Zr also improve the strength of the core metal layer.

When the contents of these substances are lower than their respective lower limits, the above-mentioned effects cannot be obtained, while when they exceed their respective upper limits, the cladding metal layer and the core metal layer themselves become susceptible to corrosion. In particular, excess Mn, Cr and Zr cause defects in these layers due to the formation of their giant intermetallic compounds.

In the heat exchangers made of the clad material according to the present invention by soldering in a non-oxidizing and reduced-pressure atmosphere, the Al-Sn base alloy near the surface of the cladding material layer works as a sacrificial anode, since it is more anodic than the core metal layer, the Al-Si base alloy fillets, and other members of the heat exchanger made of corrosion-resistant aluminum alloys, such as Al-Mg base alloys and Al-Mn base alloys, or aluminum. Therefore, pitting corrosion of the core metal layer and other heat exchanger constructing members is prevented.

Referring to FIG. 1, there is shown a corrosive type heat exchanger fluid passage member 3, such as a water pipe in a radiator of a car, which is formed by a clad material comprising a cladding metal layer 1 and a core metal layer 2 according to the present invention. In the fluid passage member 3, corrosion-current 5 is supplied to a corroded portion 4 from the Al-Sn base alloy layer of the cladding metal layer 1 near the corroded portion 4, so that corrosion proceeds in the direction of the surface of the cladding metal layer 1 without becoming pitting corrosion, whereby the life of the corrosive type heat exchange fluid passage member 3 is lengthened.

Figure 2:
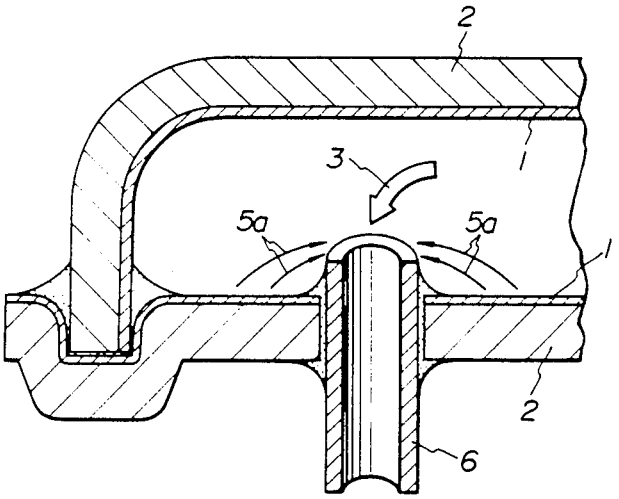
FIG. 2 illustrates the corrosion prevention effect of a clad material according to the present invention employed in a water chamber.

Referring to FIG. 2, there is shown a water chamber of a car radiator made of a clad material comprising a cladding metal layer 1 and a core metal layer 2 according to the present invention. To the water chamber, there is attached a water pipe 6 which is made of other material. In this case, the cladding metal layer 1 serves to prevent the core metal layer 2 from being corroded as in the case of the fluid passage member 3 in FIG. 1. To the water pipe 6, corrosion-current 5*a* is supplied from the cladding metal layer 1 near the water pipe 6, whereby the life of the water pipe 6 is also lengthened.

Table 1 lists examples of the cladding metal layers according to the present invention, along with their respective compositions. Table 2 lists examples of the core metal layers according to the present invention, along with their respective compositions.

In these tables, Examples A6 to A8 and Examples B6 to B8 are presented for purposes of comparison with the examples according to the present invention. The main component of the cladding metal layers and the core metal layers listed in these examples is aluminum.

TABLE 1

| | Composition (wt. %) | | | | | |
|---|---|---|---|---|---|---|
| No. | Sn | Mg | Zn | Ti | In | Ga |
| A1 | 0.04 | 0.04 | 0.2 | — | — | — |
| A2 | 0.06 | 0.1 | — | 0.1 | — | — |
| A3 | 0.06 | 0.2 | — | — | 0.1 | — |
| A4 | 0.1 | 0.4 | — | — | — | 0.1 |
| A5 | 0.4 | 0.8 | 0.1 | 0.05 | — | 0.05 |
| A6 | — | 0.5 | — | — | — | — |
| A7 | 0.1 | — | — | — | — | — |
| A8 | 1.0 | 2.0 | — | — | — | — |

TABLE 2

| | Composition (wt. %) | | | | | |
|---|---|---|---|---|---|---|
| No. | Mg | Mn | Si | Cr | Cu | Zr |
| B1 | 1.5 | — | — | — | — | — |
| B2 | 1.0 | 0.5 | — | 0.1 | — | — |
| B3 | 0.5 | — | — | — | — | 0.2 |
| B4 | 0.5 | 1.0 | 0.5 | — | 0.1 | — |
| B5 | 0.03 | 1.5 | — | 0.1 | 0.2 | — |
| B6 | — | — | 0.1 | — | 0.1 | — |
| B7 | — | 1.0 | 0.2 | 0.1 | — | — |
| B8 | 3.0 | — | 0.1 | — | — | — |

Table 3 summarizes the results of the measurement of the potentials of the above cladding metal layers and core metal layers. The measurement was conducted using ASTMD 2570 Test liquid concentrated 10 times (1,000 ppm $Cl^-$, $SO_4^{2-}$, $HCO_3^-$).

TABLE 3

| | Potential (V) | |
|---|---|---|
| No. | Room Temperature | 85° C. |
| A1 | −0.90 | −1.4 |
| A2 | −0.92 | −1.4 |
| A3 | −0.96 | −1.4 |
| A4 | −0.98 | −1.4 |
| A5 | −0.96 | −1.4 |
| A6 | −0.65 | −1.2 |
| A7 | −0.93 | −1.4 |
| A8 | −0.94 | −1.4 |
| B1 | −0.65 | −1.2 |
| B2 | −0.65 | −1.1 |
| B3 | −0.64 | −1.1 |
| B4 | −0.65 | −1.1 |
| B5 | −0.64 | −1.0 |
| B6 | −0.69 | −1.4 |
| B7 | −0.68 | −1.2 |

TABLE 3-continued

| No. | Potential (V) Room Temperature | 85° C. |
|---|---|---|
| B8 | −0.71 | −1.2 |

Table 4 shows the test results of the depth of diffusion of Sn into each core metal layer of clad materials with a thickness of 1 mm comprising the cladding metal layers listed in Table 1 and the core metal layers listed in Table 2, in combinations as listed in Table 4, when those clad materials were subjected to clad rolling and worked. In the table, the depth of the Sn diffusion is indicated by the distance from the boundary between the cladding and core metal layers to the point where the concentration of Sn in the core metal layer is 0.01 wt.%. In the table, Examples C13 through C20 are for comparison.

TABLE 4

| No. | Combinations of Cladding Metal Layer | Core Metal Layer | Clad Rolling Property | Depth of Diffusion of Sn into Core Metal Layer |
|---|---|---|---|---|
| C1 | A1 | B3 | Good | 30 |
| C2 | A2 | B3 | " | 30 |
| C3 | A3 | B4 | " | 20 |
| C4 | A4 | B4 | " | 25 |
| C5 | A5 | B4 | " | 30 |
| C6 | A3 | B1 | " | 15 |
| C7 | A3 | B2 | " | 20 |
| C8 | A3 | B3 | " | 20 |
| C9 | A2 | B4 | " | 30 |
| C10 | A2 | B5 | " | 50 |
| C11 | A4 | B2 | " | 20 |
| C12 | A4 | B5 | " | 50 |
| C13 | A6 | B3 | " | — |
| C14 | A7 | B3 | Considerable Edge Crack | 80 |
| C15 | A8 | B3 | Edge Crack | 200 |
| C16 | A3 | B6 | Good | 100 |
| C17 | A3 | B7 | " | 100 |
| C18 | A3 | B8 | " | 15 |
| C19 | A6 | B6 | " | — |
| C20 | A7 | B7 | Considerable Edge Crack | >400 |

Corrosion tests were conducted with respect to the clad materials listed in Table 4 and the results of the tests are summarized in Table 5.

The alternate wet and dry tests in Table 5 were conducted by immersing each clad material in a 5% NaCl solution of pH 3 at 40° C. for 30 minutes and then drying the same by blowing air thereon at 50° C. This procedure was repeated continuously for one month, and the maximum corrosion depth was measured with respect to each clad material.

The high temperature circulation tests were conducted in accordance with ASTMD 2570 and the solution for the tests was concentrated 10 times. In Table 5, the asterisk (*) indicates intergranular corrosion.

TABLE 5

| No. | Clad Ratio (%) | Maximum Corrosion Depth Alternate Wet & Dry Test | High Temperature Circulation |
|---|---|---|---|
| C1 | 10 | 50 | <40 |
| C2 | 10 | 50 | <40 |
| C3 | 10 | 40 | <40 |
| C4 | 10 | 40 | <40 |
| C5 | 10 | 40 | <40 |
| C6 | 10 | 40 | <40 |
| C7 | 10 | 50 | <40 |

TABLE 5-continued

| No. | Clad Ratio (%) | Maximum Corrosion Depth Alternate Wet & Dry Test | High Temperature Circulation |
|---|---|---|---|
| C8 | 10 | 50 | <40 |
| C9 | 10 | 60 | <40 |
| C10 | 10 | 70 | <40 |
| C11 | 5 | 40 | <40 |
| C12 | 15 | 80 | <40 |
| C13 | 10 | 400 | >400 |
| C14 | 10 | 110 | 180 |
| C15 | 10 | 200 | 210 |
| C16 | 10 | 200* | 360* |
| C17 | 10 | 240* | 260* |
| C18 | 10 | 180 | 320 |
| C19 | 25 | >400* | >400* |
| C20 | 30 | 260 | 140* |

In the alloys according to the present invention, additional Fe, Ni, Cr, Zr and Ti can be respectively contained in the cladding metal component in the range of less than 1% without impairing the excellent properties of the alloys. Furthermore, Fe, Ni and Ti can be respectively contained in the core metal component in the range of less than 1%.

The alloys according to the present invention exhibit the most effective corrosion-prevention effects when soldering is performed under a non-oxidizing and reduced-pressure atmosphere, for example, by vacuum soldering at less than $10^{-4}$ Torr. However, when soldering is performed under a pressure-adjusted atmosphere, for example, at 0.1 to 1 Torr in $N_2$ atmosphere, the alloys also exhibit a highly improved corrosion-prevention effect. Further, in the case where soldering is performed at atmospheric pressure, the alloys exhibit a marked corrosion-prevention effect compared with a conventional bare material which is not clad with a cladding metal layer, although the effect is not better than that produced by vacuum or pressure-adjusted soldering.

Therefore, when the alloys according to the present invention are employed, vacuum soldering and pressure-adjusted soldering can be recommended. However, normal soldering at atmospheric pressure can be also practicable. Further, the alloys according to the present invention can be employed in heat exchangers which are not soldered, for example, joint type heat exchangers.

What is claimed is:

1. A clad material for use in heat exchangers, comprising: an aluminum alloy core and a cladding on one surface of said core, said aluminum alloy core being made of a first alloy consisting essentially of 0.01 to 2.0 wt. % magnesium and the balance is aluminum, said cladding being made of a second alloy consisting essentially of 0.02 to 2.0 wt. % of magnesium, from 0.02 to 0.5 wt. % of tin and the balance is aluminum.

2. A clad material for use in heat exchangers, comprising: an aluminum alloy core and a cladding on one surface of said core, said aluminum alloy core being made of a first alloy consisting essentially of (1) 0.01 to 2.0 wt. % magnesium, (2) at least one metal selected from the group consisting of 0.01 to 2.0 wt. % manganese, 0.01 to 2.0 wt. % silicon, 0.01 to 0.5 wt. % chromium, 0.01 to 0.5 wt. % copper, and 0.01 to 0.5 wt. % zirconium, and (3) the balance is aluminum, said cladding being made of a second alloy consisting essentially of (4) 0.02 to 0.5 wt. % tin, (5) 0.02 to 2.0 wt. % magnesium, (6) at least one metal selected from the group consisting of 0.05 to 3.0 wt. % zinc, 0.01 to 0.5 wt. % titanium, 0.02 to 1.0 wt. % indium and 0.02 to 1.0 wt. % gallium, and (7) the balance is aluminum.

3. A clad material as claimed in claim 2, wherein said second alloy consists of 0.1 to 0.4 wt.% Sn, 0.4 to 0.8 wt.% Mg, 0.05 to 0.1 wt.% Ga, up to 0.05 wt.% Ti, and up to 0.1 wt.% Zn, and the balance is aluminum and unavoidable impurities.

4. A clad material as claimed in claim 3, wherein said first alloy consists of 0.5 to 1.0 wt.% Mg, 0.5 to 1.0 wt.% Mn, up to 0.5 wt.% Si, and up to 0.1 wt.% Cu, and the balance is aluminum and unavoidable impurities.

5. A clad material for use in heat exchangers, comprising: an aluminum alloy core and a cladding on one surface of said core, said aluminum alloy core being made of a first alloy consisting of 0.01 to 2.0 wt.% magnesium and the balance is aluminum and unavoidable impurities, and cladding being made of a second alloy consisting of 0.02 to 2.0 wt.% of magnesium, 0.02 to 0.5 wt.% of tin and the balance is aluminum and unavoidable impurities.

6. A clad material for use in heat exchangers, comprising: an aluminum alloy core and a cladding on one surface of said core, said aluminum alloy core being made of a first alloy consisting of (1) 0.01 to 2.0 wt.% magnesium, (2) at least one metal selected from the group consisting of 0.01 to 2.0 wt.% manganese, 0.01 to 2.0 wt.% silicon, 0.01 to 0.5 wt.% chromium, 0.01 to 0.5 wt.% copper, and 0.01 to 0.5 wt.% zirconium, and (3) the balance is aluminum and unavoidable impurities, said cladding being made of a second alloy consisting of (4) 0.02 to 0.5 wt.% tin, (5) 0.02 to 2.0 wt.% magnesium, (6) at least one metal selected from the group consisting of 0.01 to 0.5 wt.% titanium, and 0.02 to 1.0 wt.% gallium, and (7) the balance is aluminum and unavoidable impurities.

7. A clad material for use in heat exchangers, comprising: an aluminum alloy core and a cladding on one surface of said core, said aluminum alloy core being made of a first alloy consisting essentially of 0.01 to 2.0 wt.% magnesium and the balance is aluminum, said cladding being made of a second alloy consisting essentially of 0.02 to 0.5 wt.% tin, 0.02 to 2.0 wt.% magnesium, at least one metal selected from the group consisting of 0.05 to 3.0 wt.% zinc, 0.01 to 0.5 wt.% titanium, 0.02 to 1.0 wt.% indium and 0.02 to 1.0 wt.% gallium, and the balance is aluminum.

8. A clad material as claimed in claim 7, wherein said first alloy consists of 0.01 to 2.0 wt.% magnesium and the balance is aluminum and unavoidable impurities, and said second alloy consists of 0.02 to 0.5 wt.% tin, 0.02 to 2.0 wt.% magnesium, at least one metal selected from the group consisting of 0.01 to 0.5 wt.% titanium, and 0.02 to 1.0 wt.% gallium, and the balance is aluminum and unavoidable impurities.

9. A clad material for use in heat exchangers, comprising: an aluminum alloy core and a cladding on one surface of said core, said aluminum alloy core being made of a first alloy consisting essentially of 0.01 to 2.0 wt.% magnesium, at least one metal selected from the group consisting of 0.01 to 2.0 wt.% manganese, 0.01 to 2.0 wt.% silicon, 0.01 to 0.5 wt.% chromium, 0.01 to 0.5 wt.% copper, and 0.01 to 0.5 wt.% zirconium, and the balance is aluminum, said cladding being made of a second alloy consisting essentially of 0.02 to 2.0 wt.% magnesium, 0.02 to 0.5 wt.% tin, and the balance is aluminum.

10. A clad material as claimed in claim 9, wherein said first alloy consists of 0.01 to 2.0 wt.% magnesium, at least one metal selected from the group consisting of 0.01 to 2.0 wt.% manganese, 0.01 to 2.0 wt.% silicon, 0.01 to 0.5 wt.% chromium, 0.01 to 0.5 wt.% copper, and 0.01 to 0.5 wt.% zirconium, and the balance is aluminum and unavoidable impurities, and said second alloy consists of 0.02 to 2.0 wt.% of magnesium, 0.02 to 0.5 wt.% of tin and the balance is aluminum and unavoidable impurities.

* * * * *